US010436400B2

(12) United States Patent
Xie et al.

(10) Patent No.: US 10,436,400 B2
(45) Date of Patent: Oct. 8, 2019

(54) CEILING MOUNTING STRUCTURE

(71) Applicant: Xiamen Guangpu Electronics Co., Ltd., Fujian (CN)

(72) Inventors: Zhi Fu Xie, Fujian (CN); Guo Hua Lan, Fujian (CN); Fu Pai Tian, Fujian (CN)

(73) Assignee: Xiamen Guangpu Electronics Co., Ltd., Xiamen, Fujian (CN)

( * ) Notice: Subject to any disclaimer, the term of this patent is extended or adjusted under 35 U.S.C. 154(b) by 171 days.

(21) Appl. No.: 15/653,153

(22) Filed: Jul. 18, 2017

(65) Prior Publication Data

US 2018/0299085 A1 Oct. 18, 2018

(30) Foreign Application Priority Data

Apr. 14, 2017 (CN) ..... 2017 2 0395210 U

(51) Int. Cl.

| | |
|---|---|
| ***F21S 8/04*** | (2006.01) |
| ***F21S 8/06*** | (2006.01) |
| ***F21V 15/01*** | (2006.01) |
| ***F21V 11/06*** | (2006.01) |
| ***F21V 21/03*** | (2006.01) |
| *F21V 23/00* | (2015.01) |
| *F21S 8/00* | (2006.01) |
| *F21V 17/10* | (2006.01) |

(52) U.S. Cl.

CPC . *F21S 8/04* (2013.01); *F21S 8/06* (2013.01); *F21V 11/06* (2013.01); *F21V 15/01* (2013.01); *F21V 21/03* (2013.01); *F21S 8/00* (2013.01); *F21S 8/043* (2013.01); *F21V 17/107* (2013.01); *F21V 23/00* (2013.01)

(58) Field of Classification Search

CPC ..... F21S 8/04; F21S 8/043; F21S 8/06; F21V 17/107; F21V 11/06; F21V 15/01

USPC ..... 248/343

See application file for complete search history.

(56) References Cited

U.S. PATENT DOCUMENTS 3,078,366 A * 2/1963 Winkler ..... F21S 8/02 292/114
5,997,158 A * 12/1999 Fischer ..... F21S 8/04 362/364
6,045,241 A * 4/2000 Pahl ..... F21S 8/02 362/147

(Continued)

FOREIGN PATENT DOCUMENTS

DE 102011115947 A1 * 4/2013 ..... F21V 3/00
EP 2886946 A1 * 6/2015 ..... F21S 8/043

*Primary Examiner* — Eret C McNichols

(74) *Attorney, Agent, or Firm* — Muncy, Geissler, Olds & Lowe, P.C.

(57) ABSTRACT

The invention provides a ceiling mounting structure, comprising a hanging board, at least one connector and at least one guide rail of which the quantity corresponds to that of the connector, wherein one end of the hanging board is articulated with one end of the connector, and the other end of the hanging board is provided with first clamping hooks; the guide rail has one end provided with rail-type clamping hooks and the other end is provided with second clamping hooks; the connector has hook grooves; the hanging board is fixed on a ceiling; the hook grooves and the rail-type clamping hooks form rail-type sliding and are connected with in a hooking way; and the first clamping hooks and the second clamping hooks are connected in a snap-fit way.

10 Claims, 5 Drawing Sheets

(56) References Cited

U.S. PATENT DOCUMENTS

| | | | | |
|---|---|---|---|---|
| 6,182,848 | B1 * | 2/2001 | Wang | E05D 1/06 16/266 |
| 6,422,720 | B2 * | 7/2002 | Fischer | F21S 8/04 362/362 |
| 6,439,741 | B1 * | 8/2002 | Diaz | F21S 8/04 362/217.16 |
| 6,905,222 | B1 * | 6/2005 | Russello | F21S 8/033 362/147 |
| 7,160,006 | B1 * | 1/2007 | Horner | F21V 17/102 24/561 |
| 7,766,503 | B2 * | 8/2010 | Heiking | F21S 8/026 362/147 |
| 10,161,579 | B2 * | 12/2018 | Sorensen | F21V 19/001 |
| 2009/0262540 | A1 * | 10/2009 | Hargreaves | A01G 9/26 362/362 |
| 2010/0326997 | A1 * | 12/2010 | Meyer | E04F 19/08 220/751 |
| 2012/0069557 | A1 * | 3/2012 | Bolscher | F21V 21/025 362/217.16 |
| 2013/0027915 | A1 * | 1/2013 | Caferro | F21V 29/004 362/147 |
| 2013/0051078 | A1 * | 2/2013 | Kotera | F21V 27/00 362/631 |
| 2013/0250555 | A1 * | 9/2013 | Sano | F21S 8/04 362/147 |
| 2016/0010835 | A1 * | 1/2016 | Lee | F21V 21/14 362/147 |
| 2018/0045880 | A1 * | 2/2018 | Boulanger | F21V 17/10 |
| 2018/0356057 | A1 * | 12/2018 | Xu | F21S 8/04 |
| 2018/0356079 | A1 * | 12/2018 | Halliwell | F21V 21/02 |

* cited by examiner

CEILING MOUNTING STRUCTURE

BACKGROUND OF THE INVENTION

Technical Field

The invention belongs to the technical field of lighting, specifically to a ceiling mounting structure which has a simple and compact structure and is convenient to install.

Description of Related Art

As fourth-generation lighting sources, LED lamps have obvious advantages in energy conservation and life span. Along with social development, the issue of lighting energy consumption in daily life has become increasingly obvious. Thus, LED lamps with prominent energy-saving advantages have become more and more popular.

Existing LED panel lamps are usually installed in an embedded way. Such technology is mature and reliable and low in cost, but requires boring into ceilings. Since it is inconvenient to bore holes into the ceilings, installation is troublesome.

BRIEF SUMMARY OF THE INVENTION

In order to solve the above problems, the invention provides a ceiling mounting structure which has a simple and compact structure and is convenient to install.

The invention discloses a ceiling mounting structure, including a hanging board, at least one connector, and at least one guide rail of which the quantity corresponds to that of the connectors, wherein one end of the hanging board is articulated with one end of the connector, and the other end of the hanging board is provided with first clamping hooks; the guide rail has one end provided with rail-type clamping hooks which drive the connector to slide along a rail, and the other end is provided with second clamping hooks; the connector has hook grooves which are matched and hooked with the rail-type clamping hooks and in which the rail-type clamping hooks slide; the hanging board is fixed on a ceiling; the connector, together with the guide rail, forms rail-type sliding and is connected with the guide rail in a hooking way; the first clamping hooks of the hanging board are connected with the second clamping hooks of the guide rail in a snap-fit way to connect the hanging board with the guide rail, thus fixing a ceiling mounted object on the ceiling by using the ceiling mounting structure.

Further, the connector is an "H" shaped structure such that two lateral edges thereof are formed into the hook grooves, and the rail-type clamping hooks corresponding to the guide rail are reverse "L" shaped strip-like plates which face each other and respectively correspond to the two sides of the connector so that the hook grooves on two sides of the connector and the reverse "L" shaped strip-like plates perform rail sliding and hooking connection.

Further, the first clamping hooks and the second clamping hooks are clamping hooking structures of the strip-like plates with L-shaped cross sections, wherein the vertical edges thereof are respectively connected with the hanging board and the guide rail while the horizontal edges thereof are mutually connected in a snap-fit way so that the first clamping hooks and the second clamping hooks can perform rail sliding and hooking connection.

Much further, the length of the vertical edge of each one of the first clamping hooks, namely the height of each one of the first clamping hooks, is greater than the length of the corresponding one of the second clamping hooks, namely the height of the corresponding one of the second clamping hooks.

Much further, a limiting block is also disposed between each one of the first clamping hooks of the hanging board and the hanging board, and the height of each one of the limiting blocks is smaller than the height of the corresponding one of the first clamping hooks and greater than the height of the corresponding one of the second clamping hooks such that the limiting blocks prevent the second clamping hooks from sliding out after the second clamping hooks slide into the first clamping hooks.

Much further, the distance from one end of each one of the limiting blocks away from the corresponding one of the first clamping hooks to the articulated point is smaller than the distance from one end of each one of the second clamping hooks close to the corresponding one of the rail-type clamping hooks to the end of the guide rail away from the corresponding one of the second clamping hooks.

Further, the connector is also provided with screw holes for locking screws such that the connector is limited to sliding in the rail groove of each one of the rail-type clamping hooks.

Further, two connectors are provided, and correspondingly, the hanging board is provided with two first clamping hooks, wherein the two first clamping hooks are disposed in parallel and positioned on two sides of the hanging board.

Much further, the hanging board has one end provided with two first pins; each one of the two connectors has one end provided with a second pin, and the first pins are connected with the second pins in an articulated way to connect the hanging board with the two connectors.

Much further, the first pins and the second pins are articulated through bolts or screws.

Further, the hanging board and the guide rail are also respectively provided with hanging board mounting holes and guide rail mounting holes respectively by which the hanging board is installed on the ceiling and the guide rail is installed on the ceiling mounted object.

The invention employing the above technical solution has the following beneficial effects:

1. Convenient installation by configuration of the ceiling mounting structure which includes the hanging board, the connectors and the guide rail, the ceiling mounted object is installed and fixed on the ceiling through the ceiling mounting structure. The whole structure provides convenience to installation.

2. The structure is simple and compact, and after the installation is completed, the ceiling mounted object is tightly adhered to the hanging board.

DETAILED DESCRIPTION OF THE INVENTION

Figure 1:
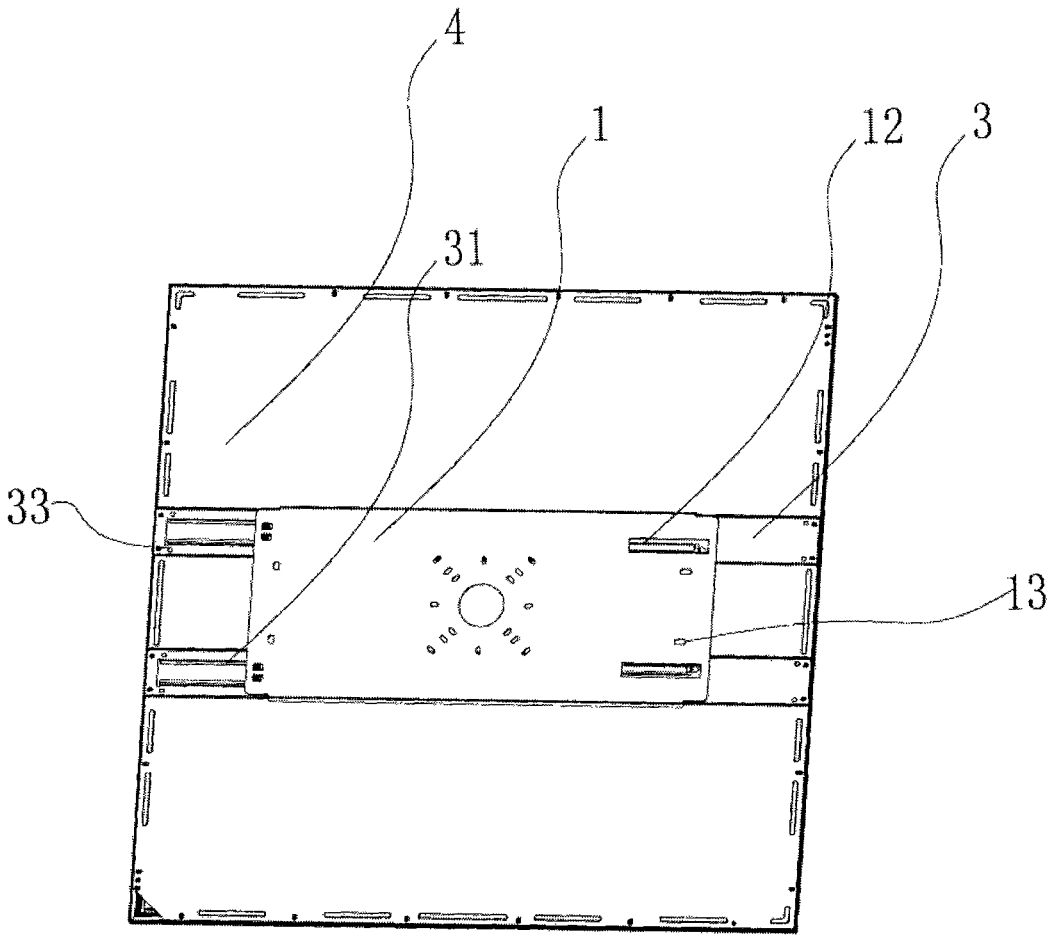
FIG. 1 is a schematic view of an assembly of the embodiment of the invention and a lamp body.

In order to further describe the embodiments, the invention is attached with drawings. The attached drawings are a part of the disclosed content of the invention and mainly used to illustrate the embodiments, and can be combined with the related content of the Specification to explain the operation principle of the embodiments. With reference to those contents, those ordinarily skilled in the art should understand other possible embodiments and the advantages of the invention. Components in the drawings are not drawn by ratio, and similar component marks are usually used to represent similar components.

The invention can be applied to various ceiling mounted objects. By using the ceiling mounting structure, the ceiling mounted objects can be conveniently installed on the ceilings. In this embodiment, the application of the invention in the installation of the lamp body is described in detail. However, the applications of the invention are not limited to lamp body installation. The invention can be used to install other ceiling mounted objects.

The invention is further described in conjunction with the attached drawings and specific implementation mode.

Figure 2:
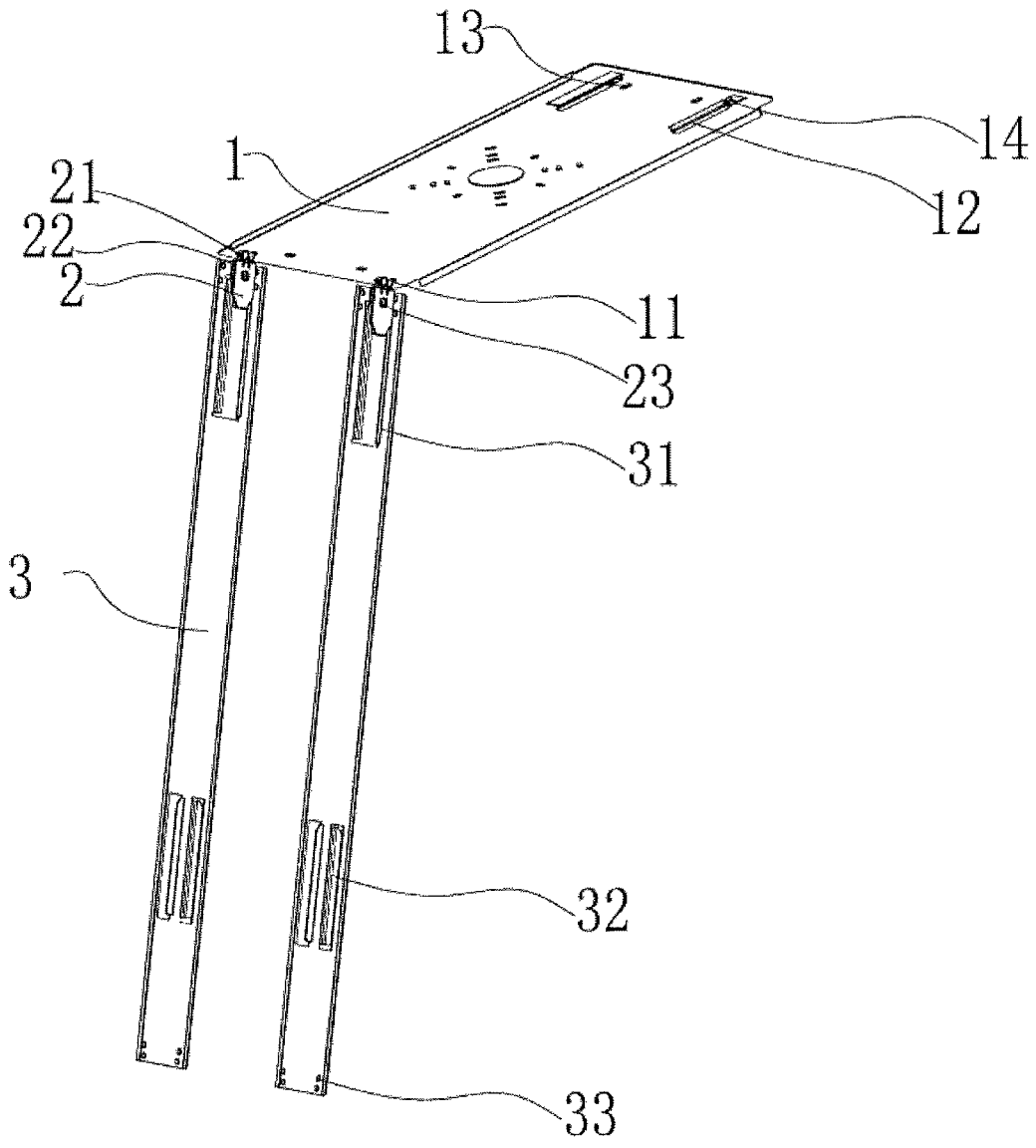
FIG. 2 is a schematic view of the connection of the embodiment of the invention.
Figure 3:
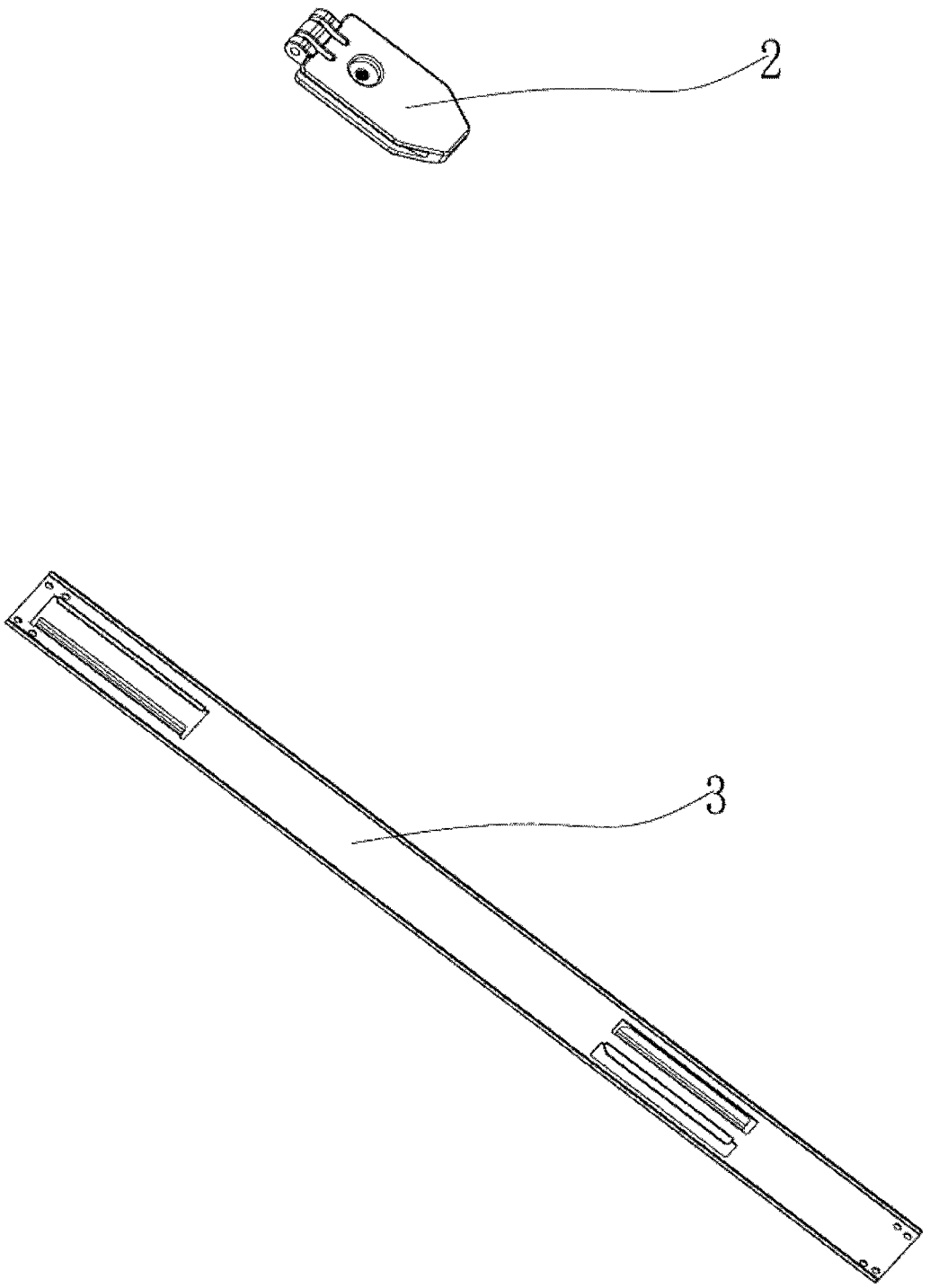
FIG. 3 is a schematic view of a connector and a guide rail of the embodiment of the invention.
Figure 4:
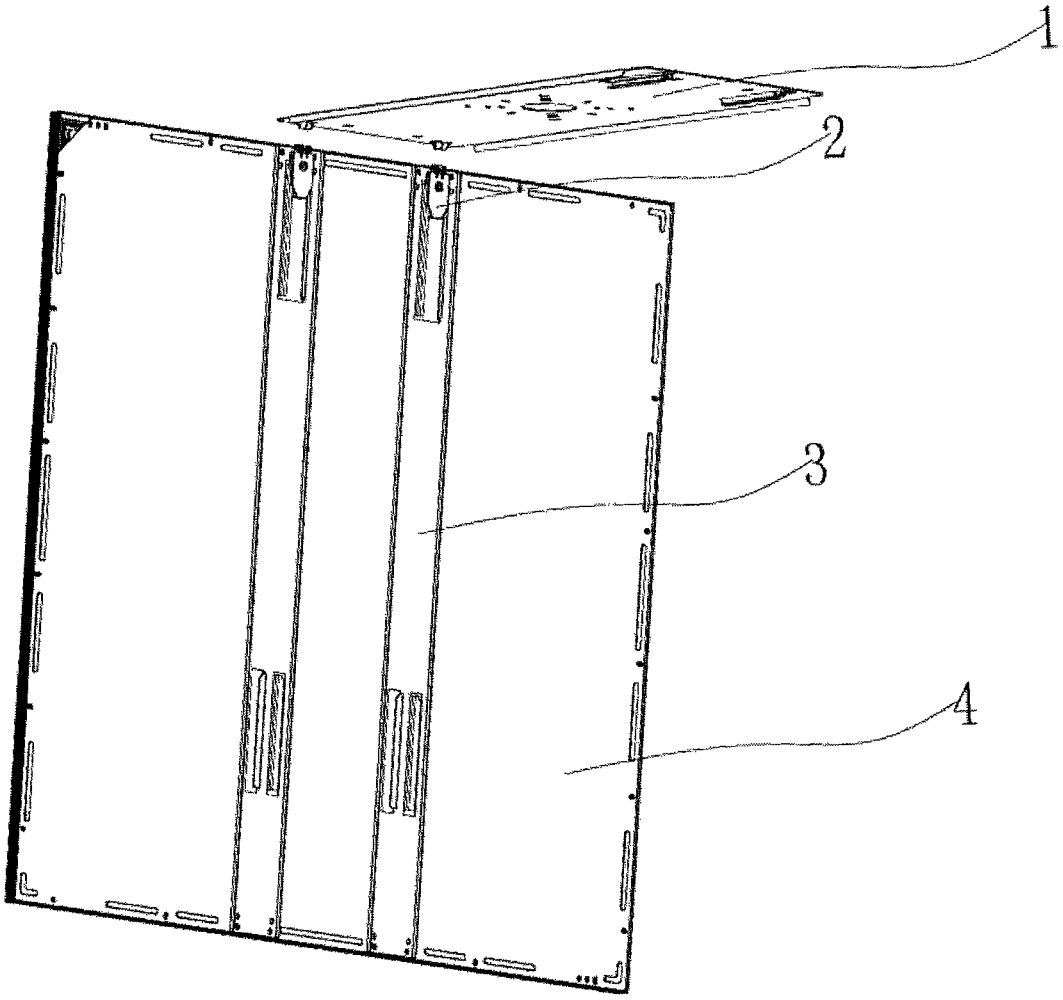
FIG. 4 is a schematic view of the connection of the embodiment of the invention and the lamp body.
Figure 5:
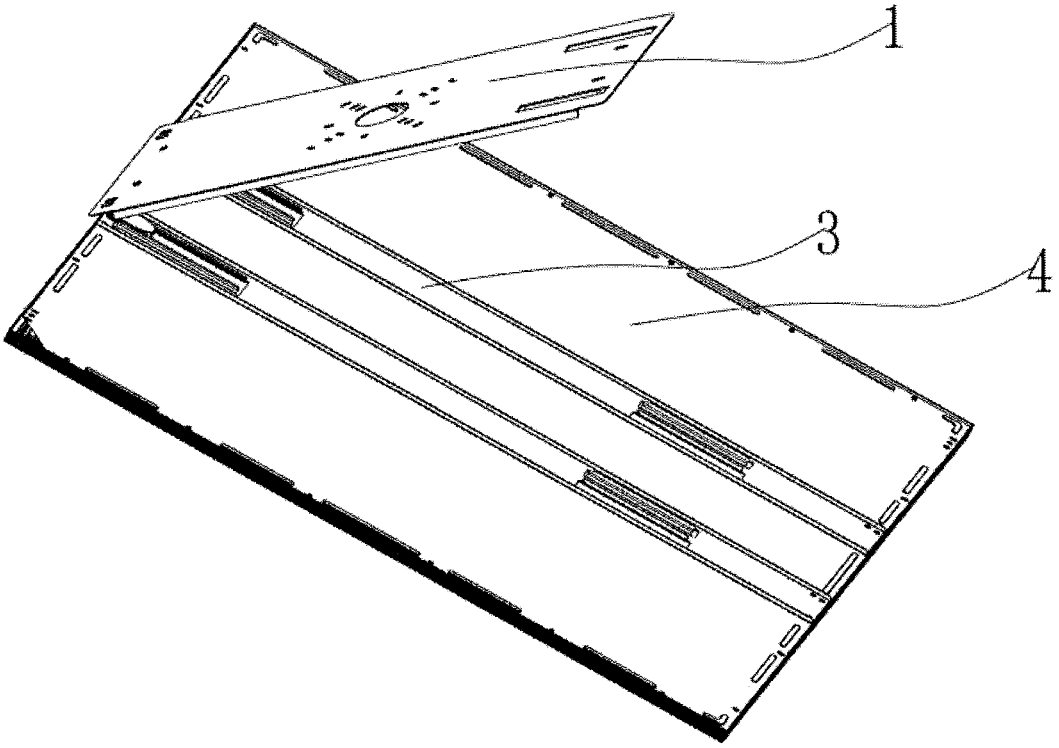
FIG. 5 is a schematic view of the installation process of the embodiment of the invention and the lamp body.

Refer to FIG. 1-FIG. 5. The embodiment discloses a ceiling mounting structure, including a hanging board 1, at least one connector 2, and at least one guide rail 3 of which the quantity corresponds to that of the connector 2, wherein one end of the hanging board 1 is articulated with one end of the connector 2, and the other end of the hanging board 1 is provided with first clamping hooks 12; the guide rail 3 has one end provided with rail-type clamping hooks 31 which drive the connector to slide along a rail, and the other end provided with second clamping hooks 32; the connector 2 has hook grooves which are matched and hooked with the rail-type clamping hooks 31 and in which the rail-type clamping hooks 31 slide; the guide rail 3 is connected with a lamp body 4; the hanging board 1 is fixed on a ceiling; the connector 2, together with the guide rail 3, forms rail-type sliding and is connected with the guide rail 3 in a hooking way; the first clamping hooks 12 of the hanging board 1 are connected with the second clamping hooks 32 of the guide rail 3 in a snap-fit way to connect the hanging board 1 with the guide rail 3, thus fixing the lamp body 4 on the ceiling by using the ceiling mounting structure.

The connector 2 is an "H" shaped structure such that two lateral edges thereof are formed into the hook grooves 22, and the rail-type clamping hooks 31 corresponding to the guide rail 3 are reverse "L" shaped strip-like plates which face each other and respectively correspond to each one of the two sides of the connector 2, so that the hook grooves 22 on two sides of the connector 2 and the reverse "L" shaped strip-like plates perform rail sliding and hooking connection. Namely, the connector 2 is equivalent to a slider of the rail and can freely slide into the rail groove of the rail.

In this embodiment, the first clamping hooks 12 and the second clamping hooks 32 are clamping hooking structures of the strip-like plates with L-shaped cross sections, wherein vertical edges thereof are respectively connected with the hanging board 1 and the guide rail 3 while the horizontal edges thereof are mutually connected in a snap-fit way so that the first clamping hooks 12 and the second clamping hooks 32 can perform rail sliding and hooking connection.

In this embodiment, the length of the vertical edge of each one of the first clamping hooks 12, namely the height of each one of the first clamping hooks 12, is greater than the vertical edge of the corresponding one of the second clamping hooks 32, namely the height of the corresponding one of the second clamping hooks 32.

In this embodiment, a limiting block 14 is also disposed between each one of the first clamping hooks 12 of the hanging board 1 and the hanging board 1, and the height of each one of the limiting blocks 14 is smaller than the height of the corresponding one of the first clamping hooks 12 and greater than the height of the corresponding one of the second clamping hooks 32 such that the limiting blocks 14 prevent the second clamping hooks 32 from sliding out after the second clamping hooks 32 slide into the first clamping hooks 12.

In this embodiment, the distance from one end of each one of the limiting blocks 14 away from the corresponding one of the first clamping hooks 12 to the articulated point is smaller than the distance from one end of each one of the second clamping hooks 32 close to the corresponding one of the rail-type clamping hooks 31 to the end of the guide rail 3 away from the corresponding one of the second hooking grooves 32. In this way, the first clamping hooks 12 and the second clamping hooks 32 are smoothly connected in a snap-fit way during installation of a ceiling lamp.

In this embodiment, the connector 2 is also formed with screw holes for locking screws such that the connector 2 is limited to sliding in the rail groove of each one of the rail-type clamping hooks 31.

In this embodiment, two connectors 2 are provided, and correspondingly, the hanging board 1 is provided with two first clamping hooks 12, wherein the two first clamping hooks 12 are disposed in parallel, and positioned on two sides of the hanging board 1. (In this embodiment, two connectors 2 are provided, and correspondingly, the hanging board 1 is provided with two first clamping hooks 12, wherein the two first clamping hooks 12 are disposed in parallel, positioned on two sides of the hanging board 1. However, the quantity of the connector 2 is not limited to two, and may be three, and correspondingly, the hanging board 1 is provided with three first clamping hooks 12, wherein the three first clamping hooks 12 are disposed in parallel, positioned on two sides of the hanging board 1.)

In this embodiment, the hanging board 1 has one end provided with two first pins 11; each one of the two connectors 2 has one end provided with a second pin 21, and the first pins 11 are connected with the second pins 21 in an articulated way to connect the hanging board 1 with the two connectors 2. The first pins 11 and the second pins 21 are connected in an articulated way through bolts or screws or other components which can perform articulated connection. (In this embodiment, the hanging board 1 and the connectors 2 are connected through articulated connection between the first pins 11 and the second pins 12, but the connection between the hanging board and the connectors is not limited to the pin connection. The connection between the hanging board 1 and the connectors 2 can be achieved by other articulated connection modes.)

In this embodiment, the hanging board 1 and the guide rails 3 are also respectively provided with hanging board mounting holes 13 and guide rail mounting holes 33 respectively by which the hanging board 1 is installed on the ceiling and the guide rails 3 are installed on the lamp body. (In this embodiment, the hanging board mounting holes 13 and the guide rail mounting holes 33 are screw holes such that the hanging board 1 is fastened on the ceiling and the guide rails 3 are fastened on the lamp body 4 by using screws, but the fastening mode of the hanging board 1 and the guide rails 3 are not limited to screw fastening. Unnecessary details are saved here).

In this embodiment, during installation, the two guide rails 3 are fixed on the lamp body 4 by using screws according to the distance between the two first clamping hooks 12 on the hanging board 1, while the two connectors 2 are fastened and articulated with the hanging board 1 by using screws, and after the two connectors 2 are aligned with and are pushed to slide into the rail-type clamping hooks 31 of the guide rails 3, the screw holes 23 of the connectors 2 are locked with screws such that the connectors 2 are limited to sliding in the rail grooves of the rail-type clamping hooks 31. Then, the lamp body 4 is wired. After wiring is completed, the lamp body 4 is rotated upward to the horizontal position; the second clamping hooks 32 are aligned with the first clamping hooks 12; the lamp body 4 is pushed to slide horizontally such that the second clamping hooks 32 slide into the first clamping hooks 12 until the second clamping hooks 32 go beyond the limiting blocks 14. By the gravity effect of the lamp body 4 and the guide rails 3, the second clamping hooks 32 and the first clamping hooks 12 are connected in a snap-fit way, completing the installation.

The ceiling mounting structure of the invention is a ceiling mounting structure including the hanging board 1, the connectors 2 and the guide rails 3. By using the ceiling mounting structure, a ceiling mounted object is installed and fixed on the ceiling. The whole structure brings convenience to installation. Moreover, the structure is simple and compact, and after the installation is completed, the ceiling mounting object is tightly adhered to the hanging board 1.

The invention is presented and introduced in conjunction with the preferable embodiments, but those skilled in the art should understand that various changes in form and in detail can be made to the invention on the basis of the essence and protective scope of the invention defined by the attached Claims, which should all fall within the protective scope of the invention.

What is claimed is:

1. A ceiling mounting structure, comprising a hanging board, at least one connector, and at least one guide rail of which the quantity corresponds to that of the connector, wherein one end of the hanging board is articulated with one end of the connector, and the other end of the hanging board is provided with first clamping hooks; the guide rail has one end provided with rail-type clamping hooks which drive the connector to slide along a rail, and the other end provided with second clamping hooks; the connector has hook grooves which are matched with and hooked with the rail-type clamping hooks and in which the rail-type clamping hooks slide; the hanging board is fixed on a ceiling; the connector, together with the guide rail, forms a rail-type sliding and connects with the guide rail in a hooking way; the first clamping hooks of the hanging board are connected with the second clamping hooks of the guide rail in a snap-fit way to connect the hanging board with the guide rail, thus fixing a ceiling mounted object on the ceiling by using the ceiling mounting structure, wherein the connector is an "H" shaped structure such that two lateral edges thereof are formed into the hook grooves, and the rail-type clamping hooks corresponding to the guide rail are reverse "L" shaped plates which face each other and respectively correspond to two sides of the connector, so that the hook grooves on the two sides of the connector and the reverse "L" shaped plates perform rail sliding and hooking connection.

2. The ceiling mounting structure according to claim 1, wherein the first clamping hooks and the second clamping hooks are clamping hooking structures of the plates with L-shaped cross sections, wherein vertical edges thereof are respectively connected with the hanging board and the guide rail while horizontal edges thereof are mutually connected in a snap-fit way so that the first clamping hooks and the second clamping hooks can perform rail sliding and hooking connection.

3. The ceiling mounting structure according to claim 2, wherein a length of the vertical edge of each one of the first clamping hooks, namely a height of each one of the first clamping hooks, is greater than a length of the corresponding one of the second clamping hooks, namely a height of the corresponding one of the second clamping hooks.

4. The ceiling mounting structure according to claim 3, wherein a limiting block is also disposed between each one of the first clamping hooks of the hanging board and the hanging board, and a height of each one of the limiting blocks is smaller than the height of the corresponding one of the first clamping hooks and greater than the height of the corresponding one of the second clamping hooks such that the limiting blocks prevent the second clamping hooks from sliding out after the second clamping hooks slide into the first clamping hooks.

5. The ceiling mounting structure according to claim 4, wherein a distance from one end of each one of the limiting blocks away from the corresponding one of the first clamping hooks to an articulated point is smaller than a distance from one end of each one of the second clamping hooks close to the corresponding one of the rail-type clamping hooks to the end of the guide rail away from the corresponding one of the second clamping hooks.

6. The ceiling mounting structure according to claim 1, wherein the connector is also provided with screw holes for locking screws such that the connector is limited to sliding in a rail groove of each one of the rail-type clamping hooks.

7. The ceiling mounting structure according to claim 1, wherein two connectors are provided, and correspondingly, the hanging board is provided with two first clamping hooks, wherein the two first clamping hooks are disposed in parallel and positioned on two sides of the hanging board.

8. The ceiling mounting structure according to claim 7, wherein the hanging board has one end provided with two first pins; each one of the two connectors has one end provided with a second pin, and the first pins are connected with the second pins in an articulated way to connect the hanging board with the two connectors.

9. The ceiling mounting structure according to claim 8, wherein the first pins and the second pins are articulated through bolts or screws.

10. The ceiling mounting structure according to claim 1, wherein the hanging board and the guide rail are also respectively provided with hanging board mounting holes and guide rail mounting holes respectively by which the hanging board is installed on the ceiling and the guide rail is installed on the ceiling mounted object.

* * * * *